United States Patent [19]

Porter

[11] 4,021,063

[45] May 3, 1977

[54] SURFACE BOLT

[75] Inventor: James T. Porter, Guilford, Conn.

[73] Assignee: Leigh Products, Inc., Coopersville, Mich.

[22] Filed: June 4, 1975

[21] Appl. No.: 583,644

[52] U.S. Cl. ..... 292/67; 292/148

[51] Int. Cl.[2] ..... E05C 1/04; E05C 13/02

[58] Field of Search ..... 292/63, 64, 65, 66, 292/67, 68, 69, 147, 148

[56] References Cited

UNITED STATES PATENTS

| | | | |
|---|---|---|---|
| 37,646 | 2/1863 | Smith | 292/67 |
| 507,889 | 10/1893 | Diblin | 292/67 |
| 2,100,622 | 11/1937 | Adams | 292/147 |
| 2,794,663 | 6/1957 | Grodt et al. | 292/67 |
| 3,752,518 | 8/1973 | Cannell | 292/42 |

FOREIGN PATENTS OR APPLICATIONS

| | | | |
|---|---|---|---|
| 159,111 | 6/1957 | Sweden | 292/148 |
| 237,939 | 9/1945 | Switzerland | 292/67 |

*Primary Examiner*—Robert L. Wolfe
*Attorney, Agent, or Firm*—DeLio and Montgomery

[57] ABSTRACT

A surface bolt adapted to be mounted on an inner or outer surface of a closure member, such as a door or window, the bolt being slidable in guides between positions into and out of engagement with a keeper, the bolt having a recess extending across its outer surface, positioned and dimensioned to be engaged by one of the guides in the locking position of the bolt and to be resiliently and releasably held in such engaged position by a spring housed in the guide. The guides are provided with means to receive the bow of a padlock in a position to prevent unlocking or locking of the bolt.

1 Claim, 6 Drawing Figures

13
29
30
12
14
22
31
24'
27
10
17
19
21
33
34
35
15
24
23
28
D
20
18
11
J

A
13
12
30
24'
14
22
15
10
17
19
34
11
26
51
20
29
24
27
16
33
28
25
31
23
D
21'
18
J
35

13
12
30
14
15
24'
22
10
17
19
11
33
34
27
51
24
16
20
29
28
25
26
23
D
18
J

SURFACE BOLT

This invention relates to a surface bolt adapted to be mounted on a closure member, such as a door or window, the bolt being slidable in guides between position into and out of engagement with a keeper or the like, the bolt having a recess on its outer surface adapted to be engaged by one of the guides in the locking position of the bolt and to be resiliently and releasably held in such engaged position by a spring housed in the guide. The guides are provided with means to receive the bow of a padlock in a position to prevent unlocking of the bolt or, in a modified form, to prevent locking or unlocking, selectively.

The present device is an improvement over similar bolts, operating similarly, wherein the spring is a leaf spring extending into the space between the guides and bearing against the under side of the bolt. It is also an improvement over the bolt shown in Keeler U.S. Pat. No. 2,620,213 wherein the body of the bolt is channeled and guides fit within the channel.

In a typical surface bolt having a retaining recess and a leaf spring, two spaced guides and a combined spring mounting and bolt stop are carried on the surface of an elongated base plate, having holes near each end for securement to the closure element, such as a door. A stop for limiting the retraction movement is provided near the end, beyond the rear guide. This assembly may be too long for use in some situations and the holes may be inconveniently spaced, so that the lock can only be used where there is room enough for the base plate and good wood opposite each screw hole.

It is an object of the present invention to provide a bolt of the character described wherein the spring is wholly contained within one of the guides.

It is another object of the invention to provide a bolt wherein each guide has its own base, for securement to a surface at any suitable point and the guides being spaced apart any convenient distance, within indicated limits.

It is a further object of the invention to provide a bolt wherein one guide is provided with a coil spring, under compression, and a bearing saddle urged by the spring against the under side of the bolt, and the other guide has only a bearing saddle.

It is a still further object to provide one guide with an extension adapted to receive the bow of a padlock in a position to hold the bolt in locking position or, alternatively, to provide each guide with such an extension for holding the bolt in locked or unlocked position, selectively.

It is yet another object of the invention to provide certain improvements in the form, construction and arrangement of the several parts whereby the above named and other objects may effectively be attained.

The invention accordingly comprises an article of manufacture possessing the features, properties, and the relation of elements which will be exemplified in the article hereinafter described, and the scope of the invention will be indicated in the claims.

A practical embodiment of the invention is shown in the accompanying drawings, wherein.

Figure 1:
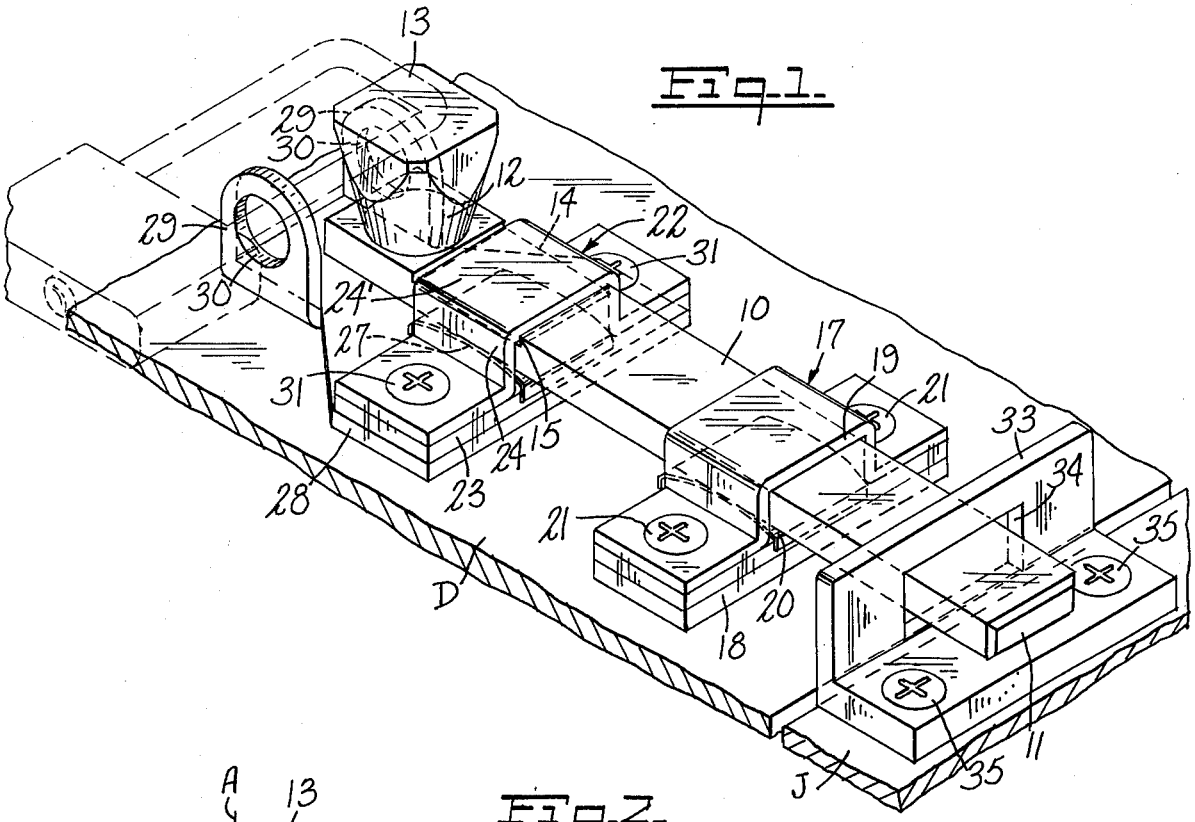
FIG. 1 is an isometric projection of the bolt mounted on the surface of a door and engaged with a keeper on an adjacent surface, such as the door jamb.
Figure 2:
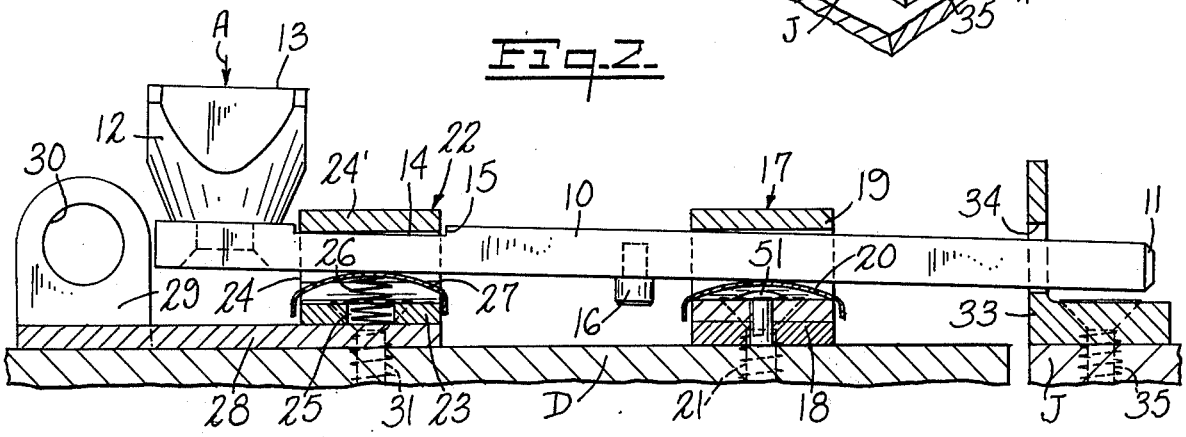
FIG. 2 is a longitudinal section through the parts shown in FIG. 1 in a plane perpendicular to that of the door surface.
Figure 3:
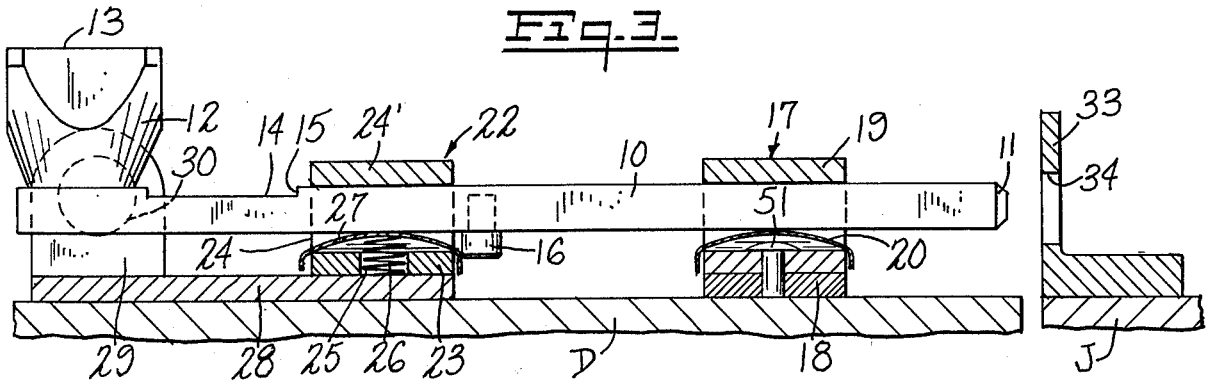
FIG. 3 is a longitudinal section as in FIG. 2 with the bolt in unlatched position.

Referring to the drawings and particularly FIGS. 1 to 3, the bolt 10 is a bar having a somewhat flat rectangular cross-section, its forward end 11 being preferably beveled along each edge, and its rearward end portion having mounted thereon an operating knob 12 with a flat top surface 13. Adjacent the knob, the surface of the bolt is provided with a transverse recess 14, at least the forward wall 15 of which lies at a right angle to the longitudinal axis of the bolt. A stop 16 is mounted on the under side of the bolt.

A first guide 17 comprises a base 18, which may be laminated, and a staple portion 19, so dimensioned as to permit free sliding movement of the bolt therethrough with additional space to accommodate an arcuately profiled saddle 20, the center of which bears resiliently against the under surface of the bolt. The guide is bored near each end to receive the mounting screws (or bolts) 21 for attaching the guide to a surface, as near one edge of a door D.

A second guide 22 comprises a base 23 and a staple portion 24, similar to the staple portion 19, the base being centrally bored at 25 and provided with a coil spring 26 under compression, biasing a saddle 27 toward the under surface of the bolt.

The base 23 corresponds to the upper lamination of base 18, the lower lamination being replaced by a lock plate 28, extending under the guide and rearwardly therefrom, the plate having a pair of upturned ears 29 with holes 30 to receive the bow of a padlock, as shown in broken lines in FIG. 1, or other retraction-arresting device such as a pin or bar. The base 23 and plate 28 are bored near each end of the base to receive mounting screws (or bolts) 31.

The bolt set is completed by the provision of a keeper 33, having an opening 34 sized to receive freely the forward end of the bolt and adapted to be mounted on a support, such as a door jamb J, by means of screws (or bolts) 35.

The recess 14 has a dimension, lengthwise of the bolt, such that it can receive freely the top run 24' of the staple 24, as shown in FIGS. 1 and 2, the bolt being urged into that position by the spring 26. When so latched, the wall 15 will catch against the edge of the guide, and the bolt will not accidentally retract. It is difficult or impossible to release the bolt from outside (i.e., from below each of the Figures). By the addition of a padlock the security is further increased. In order to free the bolt, pressure is applied in the direction of the arrow A in FIG. 2, overcoming the bias of the spring, and the bolt can then be retracted as shown in FIG. 3.

The respective guides should be so located that the stop 16 will hit the saddle 27 (as in FIG. 3) before the forward end of the bolt is drawn out of the guide 17 but after the bolt end has cleared the keeper 33. The ears 29 and holes 30 are so positioned that a padlock bow passing therethrough will prevent retraction of the bolt out of the keeper. By locating the stop 16 between the guides and the spring 26 within a guide, both out of sight, the appearance of the assembly is enhanced.

Figure 4:
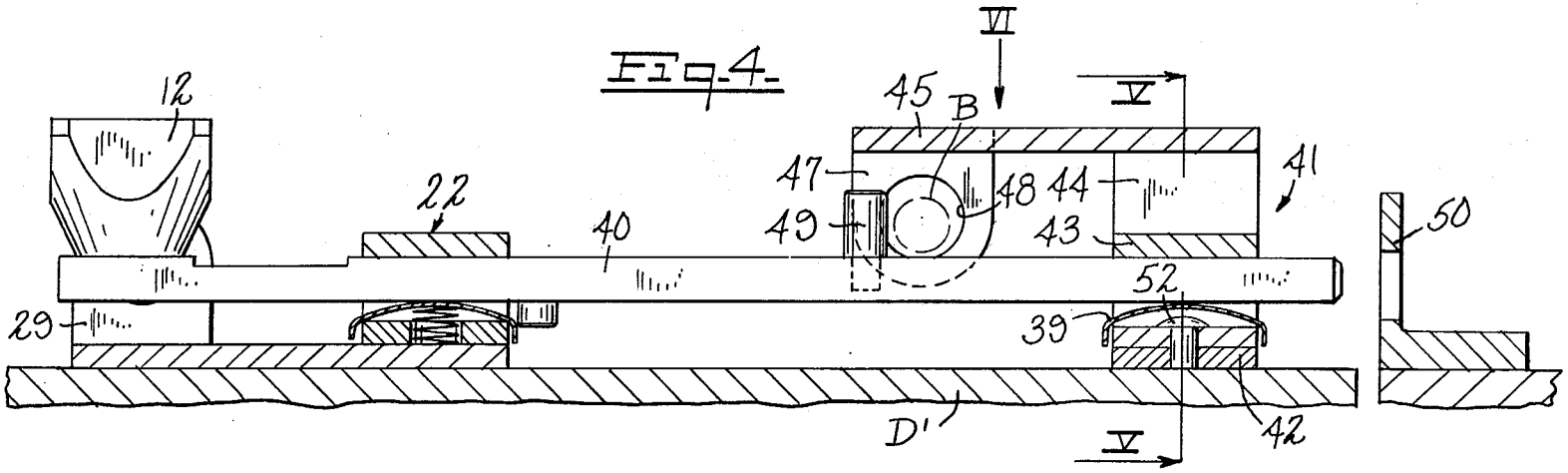
FIG. 4 is a longitudinal section, similar to FIG. 2, through a modified form of bolt assembly.
Figure 6:
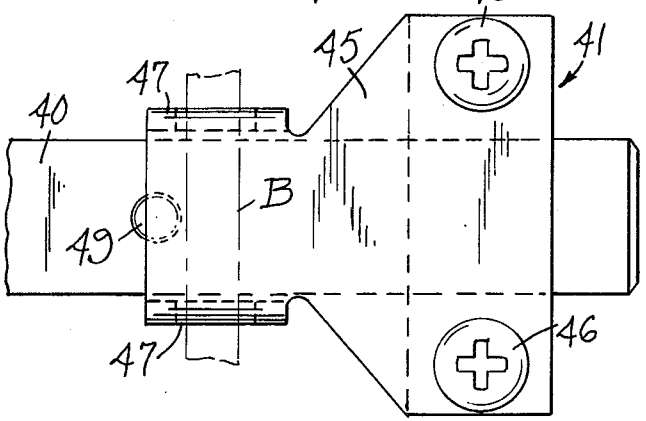
FIG. 6 is a detail plan view in the direction of the arrow VI in FIG. 4.
Figure 5:
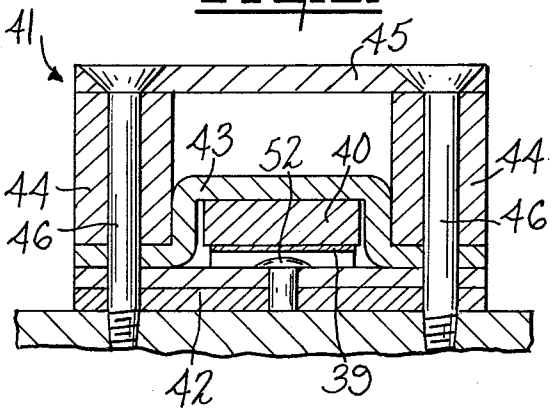
FIG. 5 is a transverse section on the line V-V of FIG. 4.

It may frequently be important or desirable to provide means to prevent the bolt from being moved, accidentally, inadvertently or mischievously, from unlocked position to locked position, and such means is shown in FIGS. 4, 5 and 6, the added features being applicable most conveniently to a bolt which is longer than that shown in FIGS. 1 to 3.

The bolt 40 shown in FIGS. 4 to 6 is somewhat longer than the bolt 10 but the features associated with its knob end (the left portion of FIG. 4) are identical with the features described in connection with the corresponding portions of FIGS. 1 to 3, and description thereof need not be repeated.

The guide 41 nearer the edge of the door D′ comprises a base 42, staple portion 43, and saddle 39 which may be identical with the parts 18,19 and 20, but spacing blocks 44 are mounted on each end portion of the staple and a lock plate 45, identical with plate 28 but inverted, is secured to the top of the blocks 44 by screws (or bolts) 46 which pass through plate 45, blocks 44, staple 43 and base 42 into the door D′. The lock plate has a pair of downturned ears 47 with holes 48 to receive the bow B of a padlock (shown in broken lines in FIGS. 4 and 6) the ears straddling the bolt 40 at a point rearward from the guide 41, and the bolt being provided with a stop 49 on its upper surface in a position to engage the padlock bow and prevent the bolt from advancing beyond the unlocked position shown in FIG. 4. The keeper 50 in FIG. 4 is the same as the keeper 33 in FIGS. 1 to 3 and serves the same purpose.

With suitable positioning of the stop 49 and the lock plate 45, a padlock engaged in the latter could act to hold the bolt in locked position, as an alternative to the provision of a lock plate 28 adjacent the guide 22.

The rivet heads 51,52 shown beneath the saddles 20 and 39, respectively, are conventional, serving to prevent the saddles (which are, in effect, short leaf springs) from collapsing or taking a set when the door on which the bolt is mounted is subjected to a sever shock, as by being hit by a vehicle.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What is claimed is:

1. A surface bolt assembly comprising, an elongated bolt body having top and bottom surfaces and forward and rearward ends, forward and rearward guides for said body, the body being slidable longitudinally in said guides between locked and unlocked positions and being provided with a recess extending transversely across its top surface adjacent the rearward end thereof, said recess being releasably engageable with the rearward guide, and resilient means within said rearward guide continuously biasing the recess toward guide engaging position, said resilient means comprising a coil spring under compression against the bottom surface of the bolt body and an arcuately profiled saddle element interposed between the coil spring and the bottom surface of said belt, and an arcuately profiled saddle element in said forward guide bearing resiliently against the bottom surface of the bolt, and a member projecting from the bottom surface of said bolt between said guides adapted to contact said rearward guide to prevent withdrawal of the bolt from said guides.

* * * * *

UNITED STATES PATENT AND TRADEMARK OFFICE

CERTIFICATE OF CORRECTION

PATENT NO. 4,021,063

DATED May 3, 1977

INVENTOR(S) : James T. Porter

It is certified that error appears in the above-identified patent and that said Letters Patent are hereby corrected as shown below:

In the ABSTRACT, delete the entire last sentence.

Signed and Sealed this second Day of August 1977

[SEAL]

*Attest:*

RUTH C. MASON
*Attesting Officer*

C. MARSHALL DANN
*Commissioner of Patents and Trademarks*